United States Patent [19]

Schaller et al.

[11] 4,175,786

[45] Nov. 27, 1979

[54] DEVICE FOR TRANSPORTING CHILDREN ON CHAIR LIFT SEATS

[76] Inventors: Herta Schaller; Herbert Schaller, both of Gusshausstrasse 6, Vienna, Austria, A-1040

[21] Appl. No.: 849,626

[22] Filed: Nov. 8, 1977

[30] Foreign Application Priority Data

Nov. 9, 1976 [AT] Austria ..... 8305/76

[51] Int. Cl.[2] ..... A47C 1/08

[52] U.S. Cl. ..... 297/254; 297/152; 297/231; 297/487

[58] Field of Search ..... 105/329 SC; 297/152, 297/216, 230, 231, 254–256, 390

[56] References Cited

U.S. PATENT DOCUMENTS

| | | | |
|---|---|---|---|
| 2,508,688 | 5/1950 | Rossi | 297/254 |
| 2,546,790 | 3/1951 | Shook | 297/255 |
| 2,851,084 | 9/1958 | Benjetsky | 297/254 |
| 3,262,736 | 7/1966 | Merelis | 297/390 X |

FOREIGN PATENT DOCUMENTS

| | | | |
|---|---|---|---|
| 659496 | 10/1951 | United Kingdom | 297/256 |

*Primary Examiner*—James C. Mitchell
*Attorney, Agent, or Firm*—McGlew and Tuttle

[57] ABSTRACT

A transport device for small children which is detachably secured to a chair lift. The transport device includes a seat sized to accommodate a child. A safety bar is pivotally mounted to the sides of the child's seat, and which when placed in a chair lift, the safety bar is positively secured in the down or fastened position in a manner to prohibit the pivoting of the safety bar to a release or unfastened position. A linking member is connected to the transport device to secure the child seat to the back of a chair lift when the child's seat is placed in a chair lift, and a central support member is connected to the safety bar so as to prohibit a child from sliding under the safety bar when in the fastened position.

10 Claims, 6 Drawing Figures

DEVICE FOR TRANSPORTING CHILDREN ON CHAIR LIFT SEATS

The present invention relates to a device for transporting children, especially small children, on chair lift seats.

So far, the transport of small children on chair lifts has been difficult, as heretofore it was common practice to transport small children on the lap of adults.

The safe transport of children on the chairs by means of straps or the like was not feasible, as fastening or releasing of the straps generally requires more time than one has at one's disposal at the valley or top station of a chair lift when in operation.

If small children are transported in the conventional type of chair lift seats, which have been constructed for adults, children have been known to fall or slip out of such seats, as they are far too big. Thus children riding on adult seats has resulted in serious injuries and even fatal accidents.

Conventional safety seats have been produced for the transport of children in private cars. However, such seats are not suited for the transport of children on chair lifts. Such safety seats are fixed to the back seats of a car, e.g. by means of screws, and the child is strapped to the seat. The necessity of a children's safety device for chair lifts can be derived from the fact that an increasing number of children of quite young age attend skiing lessons for very small children. The problem of transporting such small children is aggrevated when one adult has to take care of more than just one child.

OBJECTS

It is the object of the present invention to provide a device for the transport of children, especially small ones, on all types of chair lifts that are in use at present, whereby said device can easily and quickly be fastened to all chair lift seats so as to guarantee safe transport of children without requiring any modification at all of the existing chair lift facilities.

SUMMARY OF THE INVENTION

According to the present invention this object is attained by providing a child transport device that can be inserted into the chair lift seat and so as to prevent the child from falling off, whereby the overall dimensions of such device roughly correspond to the inside dimensions of the chair lift seat.

The carrying or transport device can, for example, be placed on a bench near the boarding-point. The children to be transported can take their seats there and be secured against falling off without disturbing the operating of the chair lift. The carrying or transport device can then be inserted into the next chair lift seat, which does not interfere with the normal operating of the chair lift as the inserting of the carrying or transport device with the child does not take any longer than the sitting down of an adult on the seat. At the top station the carrying or transport device together with the child is taken off the chair lift seat and placed somewhere aside. This does not consume extra time and does not entail a slowing-down of the chair lift, either.

A preferred embodiment of the present invention provides a carrying or transport device in the form of a seat that can be inserted into the seat of a chair lift by means of a linking element and includes a substantially U-shaped safety bar whose side arms are pivotally mounted in a horizontal axle in the upper portion of the back of the seat which is prevented from rotating by at least one locking device, when in the secured position.

The locking device can be an end portion of one of the side arms of the safety bar that rests against the seat-back when the bar is closed. In the secured position both arms preferably protrude substantially in the plane of the seat-back downwards from the horizontally positioned axle and extend, roughly at elbow-height of the child to be transported thence, laterally in the forward direction, so that the cross-piece of the U-shaped bar is approximately at the height of the abdomen. According to the invention the cross-piece of the U-shaped safety bar has a central support that rests on the seat when in the secured position, whereby the central support is disposed between the legs of the child to prevent the child from sliding through under the cross-piece. The linking element can, for example, be positioned at the seat-back and reach around the back of the chair lift seat, whereby it is preferably height-adjustable and is provided with carrying-handles. The vertical portions of the carrying-handles are positioned at a distance from the back of the seat-back that corresponds to approximately the thickness of the back of the chair lift seat. In its top position the carrying-handle releases the back of the chair lift seat and thus defines the safety seat.

A further preferred embodiment of the present invention provides a linking element that is positioned on a cross-bar linking the two end portions of the side arms of the safety bar. In this embodiment the linking element functions as a locking device, as its portion extending round the back of the chair lift seat prevents the pivoting movement of the bar.

In the following, two embodiments of the invention will be described in more detail by means of the attached drawings without being limited thereto.

DETAILED SPECIFICATION

Figure 1:
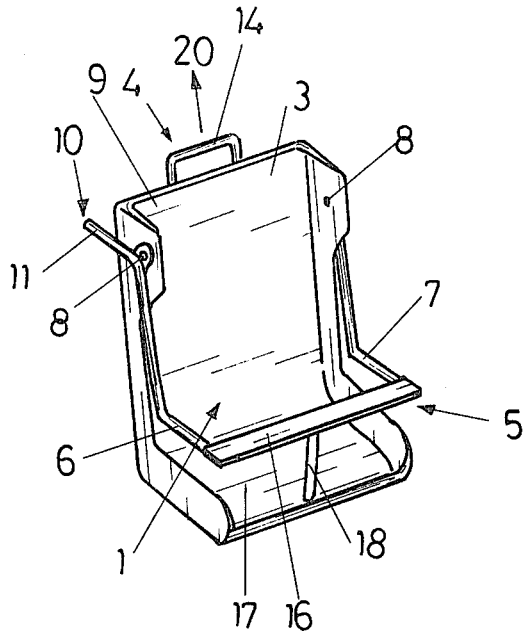
FIGS. 1 and 2 show front and rear perspective views, respectively of a first embodiment of a device according to the present invention.

The embodiment of the invention according to FIGS. 1 to 4 consists of a transport device or safety seat 1, e.g. a moulded plastic seat, comprising a back 3 and a sitting or seat portion 17, a linking element 4, that is positioned at the rear of the back 3 near its upper edge, an approximately U-shaped safety bar 5 with a cross-bar 16 and side arms 6, 7 whose end portions 11, 12 function as locking device 10. The safety bar 5 is pivotally mounted about a horizontal axle or pivot 8 in the upper portion 9 of the seat-back 3. The end portions 11, 12 functioning as locking device 10 rest against the back of the chair lift seat when the safety seat is inserted and secured in position, whereby a pivoting movement of the safety bar 5 is prevented.

As illustrated in FIG. 1, the cross-bar 16 of the safety bar 5 has a central support 18 which rests on the sitting portion 17 of the safety seat 1 when in the secured position and which is placed or located between the legs of a child sitting in safety seat 1. Due to the safety bar 5, and central support, the child can neither fall forward nor sideways, or slide off under the cross-bar 16.

Figure 2:
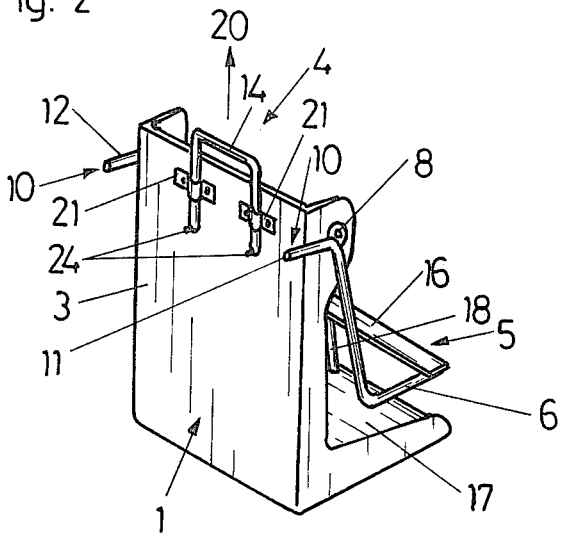

According to FIG. 2 a linking element 4 is positioned at the rear of seat-back 3 which in the illustrated embodiment comprises a carrying-handle 14 slideably positioned in brackets 21 whose top end position is limited by securing or limit pins 24 or the like. Said top end position is reached by movement in direction of arrow 20.

Figure 3:
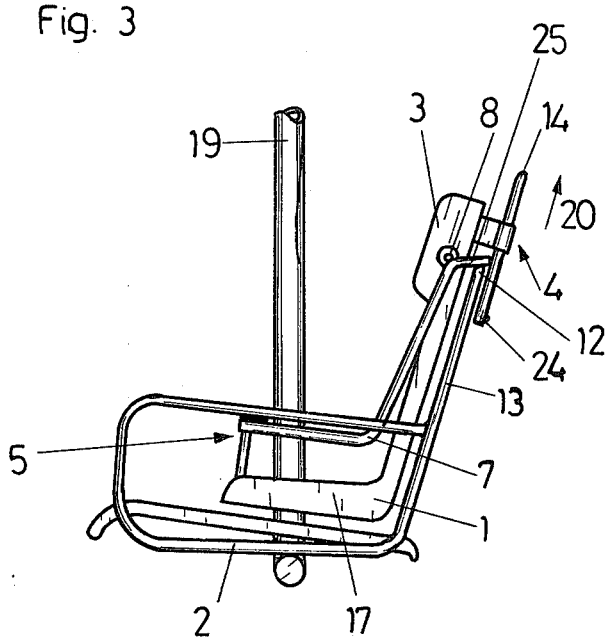
FIGS. 3 and 4 show side and back views of the device according to the present invention when inserted into a chair lift seat.
Figure 4:
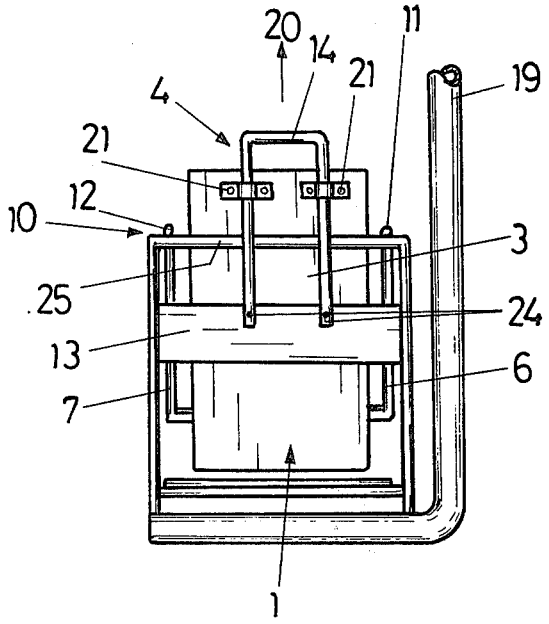

FIG. 3 is a side view of a device 1 according to the present invention when it is inserted into a chair lift seat 2. The chair lift seat 2 that is fixed to a schematically shown support 19 has a safety device for the transport of adults, e.g. a chain or a pivoting bar or the like, which is not illustrated.

The inserted safety seat 1 whose overall dimensions approximately correspond to the inside dimensions of the chair lift seat 2 rests with its back 3 on the back 13 of the chair lift seat. The linking element 4 embraces said back 13 of the chair lift seat 2 especially its top portion 25 in order to link the safety seat 1 for the child to be transported with the chair lift seat 2 in an absolutely safe way. As has been mentioned, the end portions 11, 12 (see also FIG. 4) rest against the top portion 25 of the back 13 of the seat 2 when in the secured position, which makes it impossible to push the safety bar 5 upwards during transport.

The transport of a child, especially a small one, with the help of the device according to the present invention can take place in operation, as follows:

Near the boarding point at least one of the devices 1 according to the present invention is kept ready. A child to be transported is now placed into said device 1 without disturbing the normal operation of the chair lift, whereby the safety bar 5 is pushed up and then down again as said safety bar 5 can be freely moved (see FIG. 6). Once the child is securely placed in the device 1 according to the invention, said device can be inserted into a chair lift seat 2 by an attendant without interrupting the operation of the chair lift. For this purpose said device is lifted with one hand at the carrying-handle 14 and with the other hand at the front edge of the sitting portion 17. Thereby the carrying-handle 14 slides into the top end position in direction of arrow 20.

After inserting the device 1 according to the present invention into the chair lift seat 2, the carrying-handle 14 is pushed down, whereby it reaches around the upper portion 25 of the seat-back 13. This guarantees a safe connection with the chair lift seat that cannot be separated by the child. At the same time the end portions 11, 12 of the side arms 6, 7 of the safety bar 5 rest against the upper portion 25, whereby the safety bar 5 is locked.

At the top station of the chair lift the whole procedure is carried out in reverse order. An attendant seizes the carrying-handle 14 with one hand and the front edge of the sitting portion 17 with the other hand. The carrying-handle 14 can be pulled into the top end position and the safety seat 1 can be removed from the chair lift seat 2 and placed aside without interrupting the operation of the chair lift. There the safety bar 5 that was unlocked simultaneously with the removal from the chair lift seat 2 can be pushed upwards, which enables the child to get off from seat 1 without haste and without moving safety seat 1. Any chair lift seat can transport the device back down where it can be placed on a waiting bench.

Figure 5:
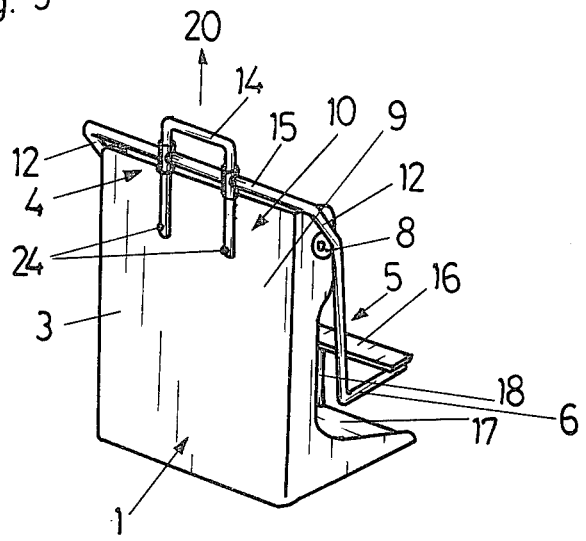
FIG. 5 shows an perspective view from the rear of a second embodiment, which can be inserted into a chair lift seat (not shown) and, FIG. 6 shows a side view of the second embodiment, when the safety bar is in the opened position.
Figure 6:
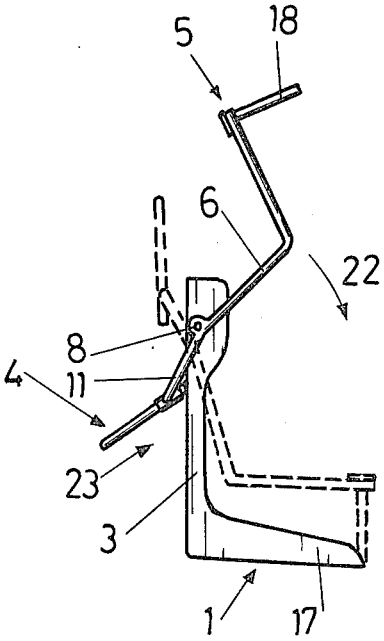

The embodiment of the device according to the invention as illustrated in FIGS. 5 and 6 is different, as the end portions 11, 12 of the side arms 6, 7 are linked by a cross-bar 15 to which the slideable height-adjustable locking device 4 is connected. The linking element 4 is preferably once again a carrying-handle 14 and reaches behind the back of the chair lift seat, whereby it functions as a locking device 10 at the same time.

The pivoting axle 8 is once again positioned in the upper portion 9 of the back 3 of seat 1 and the approximately U-shaped safety bar 5 has a central support 18 on the cross-bar 16, too.

FIG. 6 illustrates a safety bar 5 in the open position where the cross-bar 15 rests on the rear of back 3. The carrying-handle 14 is thereby in its top end position. A downward movement in the direction of arrow 22 after the child is seated leads to the position as indicated by the dash-line, and the insertion of the device into the chair lift seat takes place as described below, whereby the extended carrying-handle 14 is moved downwards in the direction of arrow 23.

The linking element 4 of the embodiment of FIG. 1 to 4 can also have the shape of a hook, as in the case where the height adjustability is not absolutely necessary.

It is essential to note that the normally provided safety device of the chair lift seat 2 need not be actuated, as its function is taken over by the safety bar 5. This is a further reason why the operation of the lift will not be interrupted.

It goes without saying that the use of the device according to the present invention is not limited to the winter season but is possible at any time of the year since the lifts are sometimes used year round for access to the mountains.

We claim:

1. A safety transport device for accommodating a child which is adapted to be detachably connected to an adult chair lift seat comprising, a safety seat having a seat portion and a connected back portion formed of a unitary construction, said safety seat being sized to accommodate a small child and to be fitted on a seat portion of an adult chair lift, a safety bar, said safety bar including a pair of side arm portions, and an interconnected cross bar adapted to extend across the lap of a small child seated in said safety seat, said side arm portion being L-shaped to extend forwardly and upwardly, said upwardly extending portions being disposed along the sides of said back portion of said safety seat, pivot means for pivotally connecting said upwardly extending portions to said back portion of said safety seat for pivoting said safety bar into an operative position, said upwardly extending portions having their respective upper ends laterally bent to extend rearwardly of said back portion of said safety seat, said rearwardly bent upper ends being adapted to extend over and contact the back portion of the chair lift seat when the safety device is connected to the chair lift seat, said rearwardly bent upper ends preventing a pivoting of and locking said safety bar in the operative position of said safety seat when said ends extend over and contact the back portion of the chair lift, a linking means for linking said safety seat to said chair lift seat, said linking means including a member connected to and disposed rearwardly of said safety seat which is slidably mounted relative to said safety seat, said member being adapted to hook over the back portion of the chair lift seat in the operative position of said safety seat and be slid downwardly behind the chair lift seat back portion, and said member defining a handle to facilitate the handling of said safety seat, and a central support connected to said cross bar, said central support extending between said cross bar and the seat portion of said safety seat.

2. A safety transport device for small children adapted to be detachably secured to an adult chair lift comprising a safety seat having a seat portion and a connected back portion, said seat portion and back portion being proportioned to accommodate a small child and which can be placed onto a chair lift seat, a safety bar pivotally connected to said safety seat, said safety bar including a pair of opposed side arm portions, and an interconnected cross bar portion, means for pivotally connecting said side arm portion to said safety seat whereby said cross bar portion is free to pivot between an operative and inoperative position so that in the operative position the cross bar extends across the lap of a child disposed in said safety seat, locking means connected to said safety bar to lock said safety bar in the operative position when the safety seat is placed in a chair lift seat, said locking means including at least one of said side arm portions having an extended end extending rearwardly of said seat back portion, said extended end being adapted to extend over a back portion of a chair lift seat whereby the extended end prohibits the pivoting of the safety bar when said safety seat is placed on said chair lift, and a linking means including a handle connected to the rear of the back portion of said safety seat and extending outwardly of said safety seat and downwardly and engageable around a top edge of the back of the chair lift seat when said safety seat is placed on the chair lift seat whereby said linking means renders the safety seat detachably connected to a chair lift seat.

3. A safety transport device, particularly for small children for securement to a support such as a chair having an upper support edge, comprising a seat including a substantially horizontal seat portion on which the child is adapted to sit, and an upright back portion rigidly connected to said seat portion, said upright back portion having a side portion on each side, a safety bar having a cross portion extending across said seat and having first and second leg portions on each side connected to respective sides of said cross portion and pivotally mounted intermediate its ends on respective side portions, each first and second leg having a part extending rearwardly of said upright back portion abuttable against the upper support edge so as to prevent a pivoting of said first and second leg portions to retain said safety bar into a locked position in which it engages over the child and locks the child in the seat, said first and second leg portions being held in the locked position by engagement with the support edge being releasable upon its being removed from the support edge, and linking means connected to said safety seat engageable on said support edge and linking said seat to said support edge and comprising a substantially U-shaped handle having spaced-apart handle legs and a web portion interconnecting said legs which extends above the top of said rear portion of said seat for engagement by a person's hand and means supporting said legs for slidable up and down movement, said legs being movable downwardly to engage behind said support edge and being movable upwardly to release said seat.

4. A safety transport device according to claim 3 including a support extending downwardly from said cross portion of said safety bar and adapted to engage between the legs of the child on said horizontal seat portion when said safety bar is in a locked position.

5. A safety transport device as defined in claim 2, said handle being slideably mounted to slide between a linking and unlinking relationship with a chair lift seat.

6. A safety transport device as defined in claim 5 wherein said handle is slideably mounted on the back portion of said safety seat, whereby said handle is adapted to hook over the back portion of a chair lift seat to link said safety seat in place on said chair lift seat.

7. A safety device as defined in claim 2 wherein the said arm portions of said safety bar are disposed substantially normal to said cross bar to extend upwardly along the sides of said seat portion, the upper ends of said arm portions being rearwardly bent to define an extension thereof, said extension being adapted to extend beyond the back portion of a chair lift seat whereby said extension defines said locking means.

8. A safety device as defined in claim 7 wherein a crosspiece is extended and interconnected between said rearwardly bent extension of said arm portions, and said linking means is connected to said cross piece.

9. A safety device as defined in claim 8 wherein said linking means includes a U-shaped member defining a handle, means on said cross piece for slideably connecting said handle to said cross piece whereby said handle is adapted to shift between a linking and unlinking position, and a limit stop connected to said handle means to limit the movement of said handle in the unlinking position.

10. A safety transport device as defined in claim 9 and including a central support connected to the cross bar of said safety bar, said central support extending between said cross bar and the seat portion of said safety seat.

* * * * *